US010544751B2

(12) United States Patent
Pramberger et al.

(10) Patent No.: US 10,544,751 B2
(45) Date of Patent: Jan. 28, 2020

(54) LIQUID-COOLED INTERNAL COMBUSTION ENGINE

(71) Applicant: AVL LIST GMBH, Graz (AT)

(72) Inventors: Harald Pramberger, Graz (AT); Robert Berger, Strallegg (AT)

(73) Assignee: AVL List GmbH, Graz (AT)

( * ) Notice: Subject to any disclaimer, the term of this patent is extended or adjusted under 35 U.S.C. 154(b) by 8 days.

(21) Appl. No.: 15/572,354

(22) PCT Filed: May 4, 2016

(86) PCT No.: PCT/AT2016/050128
§ 371 (c)(1),
(2) Date: Nov. 13, 2017

(87) PCT Pub. No.: WO2016/179618
PCT Pub. Date: Nov. 17, 2016

(65) Prior Publication Data

US 2018/0135554 A1 May 17, 2018

(30) Foreign Application Priority Data

May 12, 2015 (AT) ..... 50390/2015

(51) Int. Cl.
*F02B 75/18* (2006.01)
*F02F 1/14* (2006.01)
*F01P 3/02* (2006.01)

(52) U.S. Cl.
CPC ..... *F02F 1/14* (2013.01); *F01P 3/02* (2013.01); *F01P 2003/021* (2013.01)

(58) Field of Classification Search
CPC ..... F02F 1/14; F02F 1/166; F01P 2003/021
(Continued)

(56) References Cited

U.S. PATENT DOCUMENTS 4,846,116 A 7/1989 Sakurahara et al.
5,080,049 A * 1/1992 Solomon ..... F01P 3/02 123/41.78

(Continued)

FOREIGN PATENT DOCUMENTS

AT 504983 9/2008
CN 2751151 1/2006

(Continued)

OTHER PUBLICATIONS

English Abstract of AT504983.

(Continued)

*Primary Examiner* — Long T Tran
*Assistant Examiner* — James J Kim
(74) *Attorney, Agent, or Firm* — Dykema Gossett PLLC

(57) ABSTRACT

The invention relates to a liquid-cooled internal combustion engine comprising at least one cylinder block which has a cooling jacket (1) and comprises multiple cylinders (2). The cooling jacket (1) has a base (3) facing a crankcase and a cover (4) facing a cylinder head sealing plane (4*a*), and the base (3) has an undulating course when seen in a lateral view of the cylinder block. A first spacing ($H_2$) between two adjacent cylinders (2) in the region of at least one first motor transverse plane (8) is larger than a second spacing ($H_2$) between the base (3) of the cooling jacket (1) and the cover (4) in the region of at least one second motor transverse plane (10) containing the cylinder axis (9) when measured in the direction of the cylinder axis (9) in both cases. In order to minimize cylinder deformations, the base (3) of the cooling jacket (1) has at least one first flat section (12) arranged on a first reference plane ($\varepsilon_1$) in the region of the first motor transverse plane (8), wherein the first reference plane ($\varepsilon_1$) is preferably formed parallel to the cylinder head sealing plane (4*a*) of the cylinder block. Thus, the base (3)

(Continued)

Figure 1:
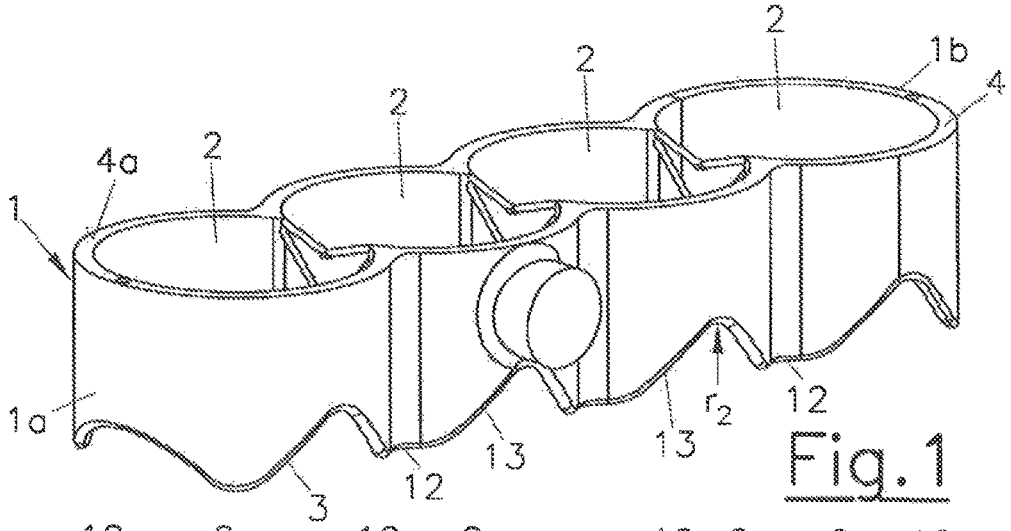

has a roof-like shape starting from the flat section in the region between the screws in the free cylinder lining region (the cylinder tube between the tapped holes).

10 Claims, 1 Drawing Sheet

(58) Field of Classification Search
USPC ..... 123/41.74, 41.72, 41.79
See application file for complete search history.

(56) References Cited

U.S. PATENT DOCUMENTS

| | | | | |
|---|---|---|---|---|
| 5,845,786 | A * | 12/1998 | Brown | B65D 85/68 211/13.1 |
| 6,397,792 | B1 | 1/2002 | Heinemann | |
| 10,036,300 | B2 * | 7/2018 | Park | F02F 1/14 |
| 2011/0132295 | A1 * | 6/2011 | Hamakawa | F02F 1/14 123/41.74 |
| 2015/0000619 | A1 * | 1/2015 | Berger | F01P 3/02 123/41.72 |
| 2015/0285125 | A1 * | 10/2015 | Hayman | F02F 1/14 123/41.72 |
| 2016/0230639 | A1 * | 8/2016 | Biller | F02F 1/10 |

FOREIGN PATENT DOCUMENTS

| | | |
|---|---|---|
| DE | 102013016358 | 7/2014 |
| JP | 2005337140 | 12/2005 |
| JP | 2008150960 | 7/2006 |
| JP | 2010151063 | 7/2010 |
| JP | 2013144995 | 7/2013 |
| WO | 9521323 | 8/1995 |
| WO | 2009112177 | 9/2009 |

OTHER PUBLICATIONS

English Abstract of CN2751151.
English Abstract of JP2005337140.
English Abstract of JP2010151063.
English Abstract of JP2013144995.
English Abstract of JP2008150960.
English Abstract of DE102013016358.

* cited by examiner

LIQUID-COOLED INTERNAL COMBUSTION ENGINE

The invention relates to a liquid-cooled internal combustion engine comprising at least one cylinder block, which has a cooling jacket, comprising multiple cylinders, wherein the cooling jacket has a bottom facing toward a crankcase and a cover facing toward a cylinder head seal plane and the bottom—observed in a side view of the cylinder block—has a wavy profile, wherein—measured in the direction of the cylinder axis in each case—a first distance in the region of at least one first engine transverse plane between two adjacent cylinders is greater than a second distance of the bottom of the cooling jacket from the cover in the region of at least one second engine transverse plane containing the cylinder axis.

In internal combustion engines, embodying the water jacket for liner cooling in the cylinder block as extending over the entire height of the cylinder liner is known. This enables complete liner cooling with only minor liner warpage because of thermal effects during the combustion. Since the bottom of the cooling jacket is arranged in this case at a relatively large distance from the cylinder head seal plane, cylinder head screws do not have a negative influence on the cylinder liner here. In addition, such internal combustion engines do not have a direct attachment of the threaded regions of the cylinder head screws to the cylinder liner.

To meet strict emission laws, cooling jackets of cylinder blocks are embodied having the smallest possible volume, whereby the warmup time of the internal combustion engine can be shortened. The cooling jacket already ends in this case—measured from the cylinder head plane—in the region between half and whole piston stroke. The region of the cylinder lining, in which the introduction of heat due to combustion of the gas mixture occurs, is thus sufficiently cooled. The higher wall temperatures forming in the regions of the cylinder liner, which are thermally noncritical and therefore are not cooled, additionally enables a reduction of the piston friction. The smaller cooling jackets also have a positive effect on the weight of the internal combustion engine.

Bottoms of the cooling jackets of cylinder blocks which are embodied as flat in a conventional manner result in the following problems: Because of the load introduction of the cylinder head screws into the cylinder block in the running region of the pistons, liner warping and strength problems occur. The load introduction of the screw forces results in local tension concentrations in the bottom of the cooling jacket. Because of the different temperature gradients along the longitudinal axis of the cylinder liner and the arrangement of the bottom of the cooling jacket in the running region of the piston, mechanical and thermal necking of the liner occurs, which results in warping of the liner and carrying capacity problems. To solve these problems, embodying the bottom of the cooling jacket as structured is known. For example, U.S. Pat. No. 5,080,049 A discloses such a cylinder block, in which the bottom of the cooling jacket has a wavy profile on one longitudinal side, wherein the distance of the bottom of the cooling jacket from the cylinder head seal plane is least in the region of the cylinder head screw axes.

WO 95/21323 A discloses a similar solution. It discloses a cooling system of a two-stroke internal combustion engine comprising multiple cylinders, which are enclosed by a cooling jacket. The bottom of the cooling jacket is made wavy and has a flow connection to a lower coolant header in the region of the engine transverse plane between two cylinders via U-shaped branch passages and vertical channel sections.

This has the disadvantage in particular that in the case of longitudinal-flow cooling jackets, where half of the mass flow is already conducted into the cylinder head during the coolant supply, sufficient cooling of all cylinders cannot be satisfactorily ensured in the region of the cylinder block. The structured bottom of the cooling jacket influences the coolant flow and prevents optimum and sufficiently adequate cooling of the cylinders most remote from the coolant inflow.

An attempt has already been made to remedy these problems by structured cooling jacket bottoms which have the flattest waviness possible, to prevent flow separations. Reference is made in this regard by way of example to DE 38 03 105 C2, where semi-cylindrical projections are provided on the bottom of the cooling jacket, which are located in regions between adjacent cylinders. However, the problems of the problematic load introduction by the cylinder head screws and/or the thermal necking due to excessively abrupt temperature gradients along the liner longitudinal axis again thus result.

EP 1 066 459 B2 discloses a solution in which the bottom of the cooling jacket of the cylinder block is embodied as curved having successive elevations and depressions located therebetween, wherein the profile of the bottom in particular represents a sine or cosine curve in cross section. A laminar flow of the coolant medium over the entire longitudinal extension of the block cooling jacket is thus to result, to achieve optimum dissipation of the heat energy without turbulence-related power losses.

This has the disadvantage in particular that unfavorable force introduction through the cylinder head screws still occurs. The continuously rising demands on the roundness of the cylinder linings for friction reduction and the boundary condition with respect to lightweight construction and increasing power density can only be met inadequately using the existing solutions.

U.S. Pat. No. 5,080,049 A describes a cylinder block for an internal combustion engine comprising multiple cylinders, wherein the cylinders are enclosed by a cooling jacket. The cooling jacket has a wavy profile on one longitudinal side of the cylinder block, wherein the distance of the bottom of the cooling jacket from the cylinder head seal plane is less in the region of a first engine transverse plane containing the cylinder head screw axes than in the region of a second engine transverse plane containing the cylinder axis.

A liquid-cooled internal combustion engine having a similarly formed cooling jacket is also known from AT 504 983 B1.

Furthermore, a cooling jacket for a crankcase is known from CN 2 751 151 Y, the bottom of which—observed in a side view—is formed as wavy. The cooling jacket has in this case a lesser distance from the cylinder head seal plane in the region of a first engine transverse plane containing the cylinder axis than in the region of a second engine transverse plane between two cylinders. The cooling of thermally highly-stressed regions is thus to be improved.

However, it is also disadvantageous here that high mechanical stresses occur in the region of the cylinder head screws, which can result in cracking in extreme cases. In particular in the region of the edge cylinders, relatively large cylinder deformations can occur.

Due to the ever higher specific powers of the internal combustion engines, the cooling problem in the cylinder block region is additionally exacerbated. In particular, the region between the cylinders is particularly strongly thermally stressed.

The thermal expansions increasingly result in liner deformations of higher orders, fourth and sixth, which hardly occur in motors which are stressed less. Due to the application of cross-flow concepts, which were developed for improved cooling of the cylinder head, which is also necessary, the through flow of the cylinder block can easily be controlled so that a sufficient heat dissipation is ensured at the cylinder arranged most remotely from the coolant supply. It is thus possible to structure the bottom of the cooling jacket in the cylinder block more strongly, without having to take the flow along the bottom into consideration.

The object of the invention is to avoid the following disadvantages of the short cooling jacket, both with linear and also flat wavy profile, namely:

- the relatively concentrated necking of the cylinder lining in the range of the highest piston speeds, in the cold and especially in the warm state;
- the concentrated load introduction of the screw forces into the cylinder tubes, which induces lining deformations of higher orders horizontally and stronger gradients vertically, and also can cause strength problems.

This is achieved according to the invention in that the bottom of the cooling jacket has at least one flat first section arranged in a first reference plane in the region of the first engine transverse plane, wherein preferably the first reference plane is formed essentially in parallel to a cylinder head plane of the cylinder block. According to one variant of the invention, the flat first section is formed extending on both sides of a first engine transverse plane.

In other words, the bottom is thus formed as extending steeply upward from the flat section between the cylinders and/or is embodied in a roof shape starting from a flat section in the region between the screws of the bottom in the free cylinder lining region (cylinder tube between the screw lugs). The cooling jacket can be formed as open on top in the cylinder block in this case, wherein cylinder head seal and cylinder head form a cover. Alternatively, a cover facing toward a cylinder head seal plane can also be integrated into the cylinder block. This design is utilized in cylinder blocks having moderate temperatures and temperature deformations, but critical mechanical strength and cylinder tube deformation, such as aluminum open deck constructions having relatively low cooling jacket.

The invention proceeds from a structured bottom for a cooling jacket of a cylinder block, which is embodied as rising in the direction of the cylinder head seal surface from the region between the cylinders toward the cylinder center. The bottom therefore extends with greater distance from the cylinder head seal in the region between the cylinders than in the cylinder center.

The invention thus consists of a structured bottom for the cooling jacket of the cylinder block, which is embodied as rising strongly in the direction of the cylinder head seal surface from the region between the cylinders toward the cylinder center, significantly more steeply than it has been constructed in existing cylinder blocks. The bottom therefore extends at substantially greater distance from the cylinder head seal surface in the region between the cylinders than in the cylinder center.

In the first section, i.e., the region between the cylinders, where the cylinder head screw boreholes are located, the bottom is embodied as essentially parallel—i.e., in consideration of manufacturing-related inaccuracies—to the cylinder head seal surface and therefore flat. The flat region of the flat first section extends in this case in the direction of an engine longitudinal axis extending in parallel to the crankshaft, measured essentially over a length of at least the diameter of a cylinder head screw, up to at most the diameter and/or the width of a cylinder head screw lug of the cylinder head.

This means, for example, upon use of an M10 cylinder head screw, approximately 20 mm lug diameter. Said longitudinal extension of the flat first section is independent in principle of whether a cylinder head screw is actually arranged above the flat first section or not.

In one embodiment of the invention, for example, the flat first section—measured in the direction of an engine longitudinal axis extending in parallel to the crankshaft—can have a length between 0.2 and 0.5 of the bore radius of an adjoining cylinder. The first section is thus, for example, 20-50% of the bore radius of an adjoining cylinder.

In a refinement of the invention, the bottom has, between at least one first engine transverse plane and one second engine transverse plane, at least one flat second section, which is arranged in a second reference plane which is arranged inclined to the first and second engine transverse planes, on the one hand, and normal to an engine longitudinal plane spanned by the cylinder axes, on the other hand. In a practical embodiment of the invention, the flat second section—measured in the direction of the engine longitudinal axis—can have, for example, a second length between 0.3 and 0.6 of the bore radius of an adjoining cylinder. The second section is therefore, for example, 30-60% of the bore radius of an adjoining cylinder.

Particularly small deformations of the cylinder may be achieved if the second reference plane encloses an angle of approximately 15° to 50°, preferably approximately 30° to 45°, with the first reference plane.

To achieve a homogeneous mechanical and thermal load in the cylinder block, the invention furthermore provides that at least two second sections are arranged symmetrically in relation to the first engine transverse plane and/or second engine transverse plane.

Starting from the flat first section, the bottom of the cooling jacket of the cylinder block therefore rises approximately to the cylinder center in the mentioned angle range in the direction of the cylinder head seal surface and then drops at the same inclination down to the next, flat first section in the adjacent intermediate region between two cylinders.

The transitions between the flat first sections and the rising flat second sections are rounded by casting and are embodied having a first transition radius. At the transition between a steeply rising second section and an adjoining falling second section, a second transition radius is provided, which is large enough that tension concentrations do not occur. With the exception of these first and second transition radii between the first and second sections, the bottom can extend essentially flat, i.e., without curvature.

Furthermore, in the scope of the invention, the cooling jacket can have three different heights, wherein a third distance of the bottom from the cover is less in at least one frontal region of the cooling jacket—preferably in the region of an engine longitudinal plane spanned by the cylinder axes—than the first distance. To achieve good heat dissipation in the frontal region of the cylinder block, on the one hand, and to generate as little mechanical and thermal tension as possible, on the other hand, it is advantageous if the third distance is greater than the second distance.

Due to the solution according to the invention, a more favorable, rounded region, which is advantageous in manufacturing, results from the flat first section in a direction normal to the longitudinal axis of the cylinder block, and in addition it enables good force introduction of the cylinder head screws.

Due to the flat bottom region at the screw lugs, a part of the screw forces can be conducted directly into the rigid liner gusset region.

At the same time, the greatest possible distance of the screws and/or their threads from the bottom of the cooling jacket of the cylinder block is enabled.

Due to the strongly inclined, but not curved bottom adjoining thereon, the other part of the screw forces is introduced into the bottom and not directly into the cylinder lining.

A relief of the bottom of the cooling jacket thus occurs, since the force introduction is deflected into the inclined flank regions below the second sections of the bottom.

The bottom of the cooling jacket describes a load cone and therefore enables a load introduction from the screw lugs into the cylinder liner without force redirection and therefore with the greatest possible uniformity into the largest possible liner region. The negative influence of a short cooling jacket on the mechanical warpage of the cylinder liner is thus minimized.

The cylinder liner deformation due to screw forces is thus reduced in comparison to existing design solutions.

Due to the consistently rising profile of the bottom of the cooling jacket, the effect of the necking of the cylinder liners is distributed with the greatest possible uniformity over the height. The cooling effect of the cooling jacket is also distributed over the largest possible region along the cylinder liner axis. The negative influence of a short cooling jacket on the vertical warpage of the cylinder liner and the thermal necking of the cylinder liner is thus also minimized.

The necking of the cylinder liner due to the significantly increased level difference of the bottom is decisively reduced by the invention in comparison to existing design concepts because of a distribution over a larger liner height. No pronounced coolant flow can form along the bottom due to the structuring. The thus worse local heat transfer results in slightly higher temperatures in the concept-related coolest region of the cylinder liner and thus further reduces the necking. (Below the cooling jacket, the wall temperature is closer to the higher oil temperature than to the lower coolant temperature of the lower cooling jacket.)

The slight increase of the wall temperature in the coolest cylinder liner region additionally also has a positive effect on the piston friction and piston ring friction, since the hydrodynamic friction decreases because of the temperature-related lower viscosity.

For the global cooling of the cylinder block, the flow in the lower cooling jacket does not have a decisive influence, since the cross-flow concepts known from the prior art, which is used for the cylinder head cooling in highly-loaded motors, ensures a good flow in the upper cooling jacket and between the cylinders in the case of web cooling.

A relatively large, deeply-extending flow cross section is also formed in the intermediate cylinder region by the invention, which provides a large surface for the heat transfer together with the flat bottom. Sufficient heat dissipation can thus occur even at lower speeds.

Figure 2:
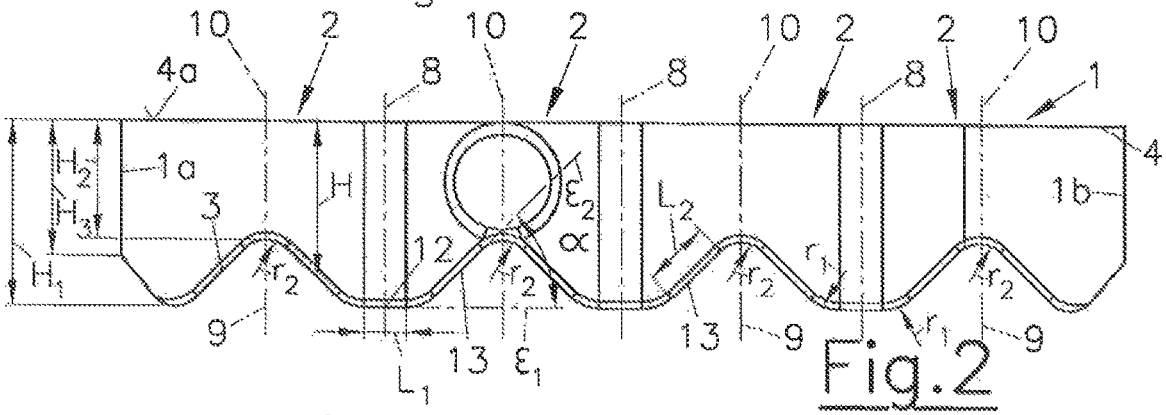
Figure 3:
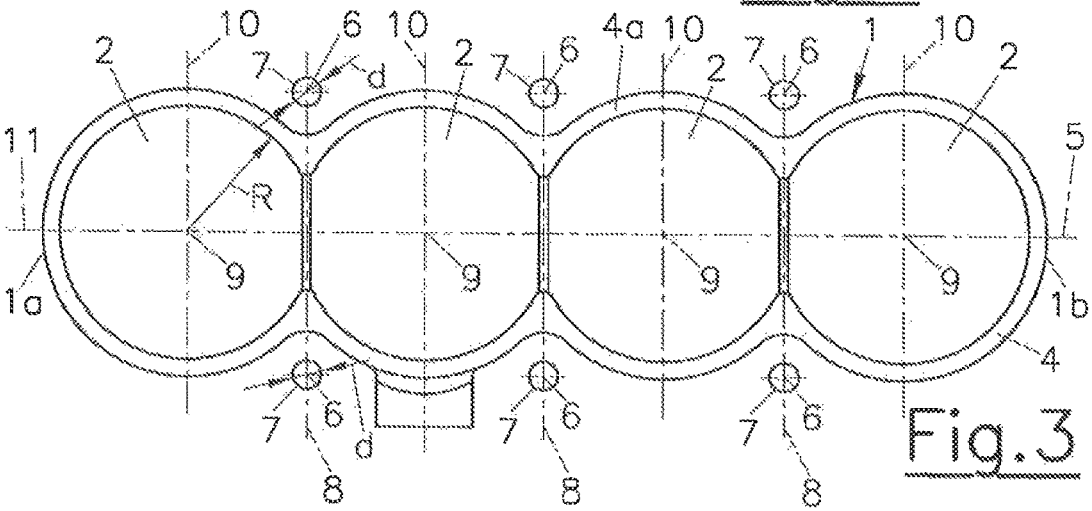

The invention will be explained in greater detail hereafter on the basis of the figures, which are not restrictive. They show:

FIG. 1 a cooling jacket of a cylinder block according to the invention in a diagonal view;

FIG. 2 the cooling jacket in a side view;

FIG. 3 the cooling jacket in a top view; and

Figure 4:
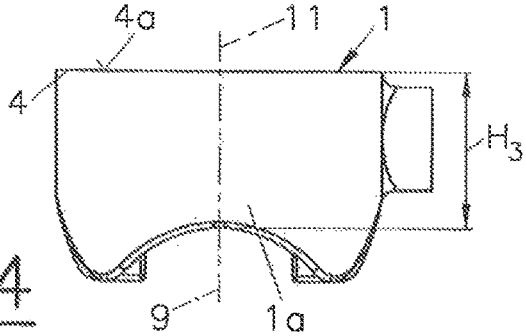

FIG. 4 a cooling jacket of a cylinder block according to the invention in a frontal view.

The figures show a cooling jacket 1, which encloses a cylinder lining, of a cylinder block (not shown in greater detail) of an internal combustion engine having four cylinders 2. The bottom 3 of the cooling jacket 1 is—as is apparent in FIG. 1 and FIG. 2—formed wavy, so that the distance H of the bottom 3 from a cover 4 of the cooling jacket 1, observed in the direction of a longitudinal axis 5 of the cylinder block, increases and decreases. The cover 4 is located in this case in the region of a cylinder head seal plane 4*a* of the cylinder block. The longitudinal axis 5 is formed, for example, by a crankshaft (not shown in greater detail) or a parallel line thereto. In detail, a first distance $H_1$ in the region of a first engine transverse plane 8, which extends between two cylinders 2—for example, through the axes 6 of the cylinder head screw boreholes 7 for the cylinder head screws—is greater than a second distance $H_2$ in the region of a second engine transverse plane 10, which includes a cylinder axis 9 in each case.

Furthermore, a third distance $H_3$ in the frontal (i.e., outwardly facing) region 1*a*, 1*b* of the edge cylinder—in particular in the region of an engine longitudinal plane 11 spanned by the cylinder axes 9—between the bottom 3 and the cover 4 of the cooling jacket 1 is less than the first distance $H_1$, and greater than the second distance $H_2$. The third distance $H_3$ between the cover 4 and the bottom 3 in the frontal region 8 of the end face 1*a*, 1*b* is, for example, approximately 50 to 80% of the first distance $H_1$ between the cover 3 and the bottom 2 in the region of the first engine transverse plane 8. Only minor mechanical and thermal tensions are thus generated in these regions.

According to the invention, the bottom 3 of the cooling jacket 1, in the region of the first engine transverse plane 8, has at least one flat first section 12, which is arranged in a first reference plane $\varepsilon_1$, extending on both sides of the first engine transverse plane 8, wherein the first reference plane $\varepsilon_1$ is formed in parallel to the cylinder head seal plane 4*a* of the cylinder block. The first length $L_1$ of the first section 12 is, in the ideal case, between the diameter d of a cylinder head screw borehole 6 and the diameter and/or the width of a cylinder head screw lug. In the exemplary embodiment, the flat first section 12 has a first length $L_1$, which is between 0.2 and 0.5 (and/or 20-50%) of the bore radius R of an adjoining cylinder 2.

Between the first engine transverse plane 8 and the second engine transverse place 10, the bottom 3 has at least one flat second section 13, which is arranged in a second reference plane $\varepsilon_2$, which is arranged inclined in relation to the first engine transverse plane 8 and the second engine transverse place 10, on the one hand, and normal to the engine longitudinal plane 11 spanned by the cylinder axes 9, on the other hand. The flat second section 13 has—measured in the direction of the engine longitudinal axis 5—a second length $L_2$ between 0.3 and 0.6 (and/or 30-60%) of the bore radius R of an adjoining cylinder 2. The second reference plane $\varepsilon_2$ encloses an angle $\alpha$ of approximately 15° to 50°, preferably approximately 30° to 45°, with the first reference plane $\varepsilon_1$.

Starting from the flat first section 12, the bottom 3 of the cooling jacket 1 of the cylinder block—observed in FIG. 2—therefore rises in the mentioned angle range a in the direction of the cylinder head seal surface 4*a* up to approximately the cylinder center and/or the second engine transverse plane 10 and then falls at the same inclination up to the next, flat first section 12 in the adjacent region of the first engine transverse plane 8 between two cylinders 2.

The transitions between the flat first sections 12 and the rising flat second sections 13 are rounded by casting and are embodied having a first transition radius $r_1$. At the transition in the region of the second engine transverse plane 10 between a steeply rising second section 13 and an adjoining falling second section 13, a second transition radius $r_2$ is provided, which is large enough that no flow separation or turbulence occurs in the coolant flow of the cooling jacket 1. Except for the first transition radii $r_1$ and second transition radii $r_2$ between the first sections 12 and second sections 13, the bottom 3 extends essentially without any curvature, i.e., flatly.

As can be seen in FIG. 1 and FIG. 2 in particular, a rounded region results starting from the first section 12 in a direction normal to the longitudinal axis 5 of the cylinder block, which is favorably designed for manufacturing and enables good force introduction of the cylinder head screws into the cylinder block. At the same time, the greatest possible distance of the cylinder head screw boreholes 7 from the bottom 3 of the cooling jacket 1 of the cylinder block is enabled. A relief of the bottom 3 of the cooling jacket 1 thus occurs, since the force introduction is deflected into the inclined flank regions below the second sections 13 of the bottom 3. The bottom 3 of the cooling jacket 1 describes a load cone and therefore enables a load introduction from the screw lugs into the cylinder liner without force redirection and therefore with the greatest possible uniformity into the largest possible region of the cylinder liner. The negative influence of a short cooling jacket on the mechanical warpage of the cylinder liner is thus minimized.

The effect of the necking of the cylinder liners is distributed with the greatest possible uniformity over the height by the consistently rising profile of the bottom 3 of the cooling jacket 1. The cooling effect of the cooling jacket 1 can also be distributed over the largest possible region along the cylinder liner axis. The negative influence of a short cooling jacket on the vertical warpage of the cylinder liner and the thermal necking of the cylinder liner is thus also minimized.

Due to the V or A shape of the bottom 3 of the cooling jacket in the region of the second engine transverse plane 10, a possibly provided reinforcement rib extending on the outer wall of the cylinder block in the direction of the cylinder axis, which is also referred to as an acoustic rib, can be incorporated better into the cylinder block structure and the warpage of the cylinder liner can thus be reduced.

The invention claimed is:

1. A liquid-cooled internal combustion engine comprising:

at least one cylinder block including a cooling jacket, and multiple cylinders, wherein the cooling jacket has a bottom facing toward a crankcase and a cover facing toward a cylinder head seal plane and the bottom—observed in a side view of the cylinder block—has a wavy profile, wherein—measured in each case in the direction of a cylinder axis—a first distance in the region of at least one engine transverse plane between two adjacent cylinders is greater than a second distance ($H_2$) of the bottom of the cooling jacket from the cover in the region of at least one second engine transverse plane containing the cylinder axis, wherein the bottom of the cooling jacket in the region of a first engine transverse plane of the at least one engine transverse plane has at least one first flat section arranged in a first reference plane, wherein preferably the first reference plane ($\varepsilon_1$) is formed parallel to the cylinder head seal plane of the cylinder block.

2. The internal combustion engine according to claim 1, wherein the flat first section is formed extending on both sides of the first engine transverse plane.

3. The internal combustion engine according to claim 1, wherein the flat first section—measured in a direction of an engine longitudinal axis extending in parallel to the crankshaft—has a length which corresponds to at least the diameter of a cylinder head screw borehole.

4. The internal combustion engine according to claim 1, wherein the flat first section—measured in a direction of an engine longitudinal axis extending in parallel to the crankshaft—has a first length, which corresponds to at most the diameter and/or the width of a cylinder head screw lugs of the cylinder block.

5. The internal combustion engine according to claim 1, wherein the bottom has, between the at least one first engine transverse plane and the at least one second engine transverse plane, at least one flat second section, which is arranged in a second reference plane, which is arranged inclined in relation to the first engine transverse plane and a second engine transverse plane of the at least one second engine transverse plane, and normal to an engine longitudinal plane spanned by the cylinder axes.

6. The internal combustion engine according to claim 5, wherein the flat second section—measured in the direction of the engine longitudinal axis—has a second length between 0.3 and 0.6 of the bore radius of an adjoining cylinder.

7. The internal combustion engine according to claim 5, wherein the second reference plane encloses an angle of approximately 15° to 50°, preferably approximately 30° to 45°, with the first reference plane.

8. The internal combustion engine according to claim 5, wherein at least two second sections are arranged symmetrically in relation to the first engine transverse plane and/or the second engine transverse plane.

9. The internal combustion engine according to claim 1, wherein the cooling jacket has at least three different distances between bottom and cover, wherein a third distance of the bottom from the cover in at least one frontal region of the cooling jacket—preferably in a region of an engine longitudinal plane spanned by the cylinder axes—is less than the first distance ($H_1$).

10. The internal combustion engine according to claim 9, wherein the third distance is greater than the second distance.

* * * * *